US008471166B1

(12) United States Patent
Glaser

(10) Patent No.: US 8,471,166 B1
(45) Date of Patent: Jun. 25, 2013

(54) DOUBLE BREAK VACUUM INTERRUPTER

(76) Inventor: Michael David Glaser, Brookfield, WI (US)

( * ) Notice: Subject to any disclaimer, the term of this patent is extended or adjusted under 35 U.S.C. 154(b) by 382 days.

(21) Appl. No.: 13/012,176

(22) Filed: Jan. 24, 2011

(51) Int. Cl.
*H01H 33/666* (2006.01)

(52) U.S. Cl.
USPC ..... 218/140; 218/16; 218/124

(58) Field of Classification Search
USPC ..... 218/139–140, 124, 16
See application file for complete search history.

(56) References Cited

U.S. PATENT DOCUMENTS

| | | | | |
|---|---|---|---|---|
| 2,859,309 | A | 11/1958 | Schwager et al. | |
| 2,863,026 | A | 12/1958 | Jennings | |
| 3,250,880 | A | 5/1966 | Jennings | |
| 3,283,101 | A | 11/1966 | Combine et al. | |
| 3,405,245 | A | 10/1968 | Ito et al. | |
| 3,792,213 | A | 2/1974 | Kane et al. | |
| 3,813,506 | A | 5/1974 | Mitchell | |
| 3,839,612 | A | 10/1974 | Badey et al. | |
| 4,027,123 | A | 5/1977 | Ihara | |
| 4,107,496 | A | 8/1978 | Clason | |
| 4,246,458 | A | 1/1981 | Yanabu et al. | |
| 4,871,888 | A | 10/1989 | Bestel | |
| 4,972,055 | A | 11/1990 | Perulfi et al. | |
| 5,905,242 | A * | 5/1999 | Bernard et al. | 218/16 |
| 5,917,167 | A | 6/1999 | Bestel | |
| 6,242,708 | B1 | 6/2001 | Marchand et al. | |
| 6,255,615 | B1 | 7/2001 | Kimblin | |
| 6,476,338 | B2 | 11/2002 | Shioiri et al. | |
| 6,498,315 | B1 | 12/2002 | Betz et al. | |
| 6,720,515 | B2 | 4/2004 | Renz et al. | |
| 6,867,385 | B2 | 3/2005 | Stoving et al. | |
| 7,239,492 | B2 | 7/2007 | Heimbach et al. | |
| 8,049,130 | B2 * | 11/2011 | Kobayashi et al. | 218/140 |
| 8,168,909 | B2 * | 5/2012 | Kobayashi et al. | 218/5 |
| 2006/0016787 | A1 | 1/2006 | Stoving et al. | |
| 2007/0262054 | A1 | 11/2007 | Sato et al. | |
| 2008/0245772 | A1 | 10/2008 | Anger et al. | |
| 2009/0032500 | A1 * | 2/2009 | Kobayashi et al. | 218/140 |
| 2009/0173719 | A1 * | 7/2009 | Kobayashi et al. | 218/140 |
| 2010/0108643 | A1 * | 5/2010 | Gentsch | 218/124 |
| 2011/0062117 | A1 * | 3/2011 | Tsuchiya et al. | 218/139 |

FOREIGN PATENT DOCUMENTS

| | | | |
|---|---|---|---|
| DE | 3811833 | A1 * | 10/1989 |

* cited by examiner

*Primary Examiner* — Truc Nguyen
(74) *Attorney, Agent, or Firm* — Donald J. Ersler

(57) ABSTRACT

A double break vacuum interrupter includes a first contact system with an annular stationary contact, which is engaged by a primary moving contact with the moving contact rod extending through the primary moving contact and through the opening of the annular stationary contact. A second contact system includes a secondary moving contact disposed on an end of the moving contact rod, which engages and operates a floating contact on the same axis. Both contact systems are enclosed in a sealed envelope. A mechanical adjustment system is provided for the floating contact, which controls its range of motion. The mechanical adjustment system allows the first and second contact systems to engage at approximately the same time. A system of capacitors and resistors is provided to balance the voltage between the first and second contact systems to provide more efficient interruption of the electric current.

20 Claims, 7 Drawing Sheets

DOUBLE BREAK VACUUM INTERRUPTER

BACKGROUND OF THE INVENTION

1. Field of the Invention

The present invention relates to the field of high voltage vacuum switches and circuit interrupting devices and more particularly to a double break vacuum switch or vacuum interrupter with two contact breaks connected in series and driven by a single contact rod.

2. Discussion of the Prior Art

A number of vacuum prior art arrangements are directed to provide a vacuum interrupter with two or more contacts within the same envelope as illustrated in U.S. Pat. Nos. 3,250,880; 3,405,245; 4,107,496; 4,246,458 and 6,476,338 B2. The first three cited patents present devices in which two moving contact structures must be moved in opposite directs to achieve two series contact breaks, necessitating a complex and costly operating mechanism. The latter two patents represent devices that rely on the transfer of the electric arc to one or more sets of auxiliary contacts as the moving contact is drawn past them. This can result in longer arcing times as the moving contact is drawn through its stroke to establish the multiple breaks as well as severe erosion along the edges of the contacts at the arc transfer points.

A more common practice for creating switchgear with two or more contact breaks in series is to simply mount the required number of single break vacuum interrupters in series as shown by U.S. Pat. Nos. 2,859,309; 3,792,213; 3,813,506; 3,839,612; 4,027,123; 4,972,055; 6,242,708; 6,498,315 B1; 7,239,492 B2. This practice requires the use of complex and costly interconnecting mechanisms for the series interrupter modules and results in a bulky switchgear unit.

Other prior art vacuum interrupters utilize multiple contact systems in an axial configuration as illustrated in U.S. Pat. Nos. 6,255,615 B1, 6,720,515 B2 and patent application US 2008/0245772 A1. These vacuum interrupters engage one set of contacts by having the contact operating means move in one direction and engage a second set of contacts when the contact operating means moves in the opposite direction. This configuration is suitable for providing a means to ground the electric circuit in which the vacuum switch or interrupter is employed, but because the contact means is not capable of engaging both sets of contacts by moving in one direction, the device does not provide a double break mechanism.

Another prior art interrupter utilizes multiple contact systems where one set of contacts drives another as illustrated in U.S. Pat. No. 2,863,026. In this case, the operating spring for the driven contact is mounted inside the interrupter and is subject to annealing during the brazing together of the interrupter. While work hardening will result in the return of some of the spring force characteristics, its final force characteristics will be uncontrolled. Additionally, no means is provided to precisely position the driven contact, adjust out the tolerance accumulation between the multiple parts or to balance the voltage between the two contact gaps.

U.S. Pat. No. 3,283,101 and Patent application publication no. US 2007/0262054 A1 disclose a double break vacuum interrupter, which is operated by a single moving contact rod. The first cited patent shows an extremely complex method of assuring that the contacts make and break at the same time. However, U.S. Pat. No. 3,283,101 does not indicate the use of capacitance to balance the voltages between the two contact gaps. With the cited patent application, there is no indication of how tolerance accumulation of the components and contact wear are accounted for to assure that both contact breaks can continue to make over the life of the device. In addition, the fact that the contact structures are mounted in a parallel configuration results in a bulky vacuum module.

Patent application publication no.: US 2010/0108643 A1 also discloses a double break vacuum interrupter, which is operated by a single contact rod. This device contains an internally mounted bellows like spring, which would become annealed during the interrupter brazing cycle which would greatly affect its force characteristics. The spring would regain some of its spring force with work hardening; however its final force characteristics would be uncontrolled. When the contacts close, the contact rod drives one moving contact into the second moving contact and then the second contact into the stationary contact which provides for making on only one set of contacts instead of two, which can result in a longer pre-strike and possible welding of the contacts. In addition there is a further possibility of contact welding as the contact rod only drives one contact open, with the internal spring returning the other contact to the open position.

While the aforementioned prior art arrangements may be suitable for their intended use in accordance with their respective defined applications, as discussed hereinbefore, it would be desirable to provide an efficient and compact double break contact arrangement contained within a vacuum switch or interrupter module.

SUMMARY OF THE INVENTION

Accordingly, it is the principal object of the present invention to provide a single vacuum interrupter module with two contact breaks connected in series and driven by a single contact rod.

In the practice of the invention, the primary contact system has an annular stationary contact, which is engaged by a disc shaped moving contact. Both contacts are preferably fabricated of copper-tungsten material, if the interrupter is designed for switching duty or chromium-copper, if the interrupter is designed to interrupt fault currents. The base of the stationary contact is supported between two tubular insulators, which are preferably made of ceramic and form the main portion of the interrupter housing. One of these insulators contains the first contact system. An end of the insulator is closed off by an end-cup preferably fabricated from stainless steel, which has an opening for the contact drive rod. The contact rod is preferably made of copper with a stainless steel reinforcing rod to prevent a reduction in length due to repeated impact. A flexible bellows preferably fabricated from stainless steel is used to allow motion of the drive rod and allow for sealing of the end-cup. The drive rod for the moving contact disc extends through the disc and annular stationary contact into the region of the second insulator. A second moving contact disc is mounted on the end of the drive rod and is engaged by a floating contact disc mounted on an independent contact rod. These contacts are also preferably fabricated from copper-tungsten or chromium-copper material and the independent contact rod is also preferably fabricated from copper with a stainless steel reinforcing rod. This contact rod is mounted on the other end of the second insulator using a bellows and end-cup arrangement to allow sealing and free motion of the floating contact. The floating contact is driven by the motion of the second moving contact, which is directly coupled to the first contact system.

A mechanism is mounted on the end-cup that supports the floating contact and allows the tolerance accumulation of the components to be adjusted out and the floating contact positioned so that the second moving contact and floating contact can be closed just before the primary contacts. The mechanism also has the capability of controlling the range of motion of the floating contact so that it may be contacted by the second moving contact at approximately the same time the primary contacts close.

The mechanism includes an annular housing with two long slots along the main axis placed 180 degrees apart. The length of these slots is the sum of the diameter of the holes in the adjuster described below plus the full range of tolerance accumulation of all parts that determine the spacing between the primary and secondary contacts. This allows the mechanism to have the capability of adjusting out the tolerance build-up in the system. The housing also has an internal thread to allow the insertion of the adjuster. The moving contact rod for the floating contact has a cross-hole placed in a position to allow the adjuster movement through its required range within the housing. A fixture pin placed in a through hole in the contact rod of the floating contact passes through both slots formed through the housing. In this manner, when the interrupter is processed through a brazing cycle, the relationship between the contact rod and housing is established and the housing can also be used as a bellows anti-twist device. After the interrupter is brazed, the fixture pin is removed and an annular adjuster with external thread is screwed into the housing. The adjuster has six holes spaced 60 degrees apart, perpendicular to the main axis and of a diameter that is calculated to provide a small amount of over travel (approximately 1/32 inch) to accommodate any erosion or compression of the primary contacts due to interruption duty and repeated impact upon closing. The adjuster also has a counter-bore into which a compression spring or series of Bellville washers may be inserted. With the primary contacts held together, the adjuster is rotated so that the lower edge of the holes are below the cross-hole in the moving contact rod by a planned contact wear allowance. The multiple holes in the adjuster allow for a finer adjustment in determining this setting. Once the adjustment is complete, a pin is inserted so that it passes through the housing, contact rod and adjuster and is secured with washers and retaining rings at both ends. A compression spring or a series of Bellville washers of appropriate design provide the required contact pressure for the secondary contacts and return force for the floating contact. The spring is placed in the counter-bore of the adjuster and is secured in place with a threaded cap. This forces the pin through the contact rod to the lower portion of the adjuster cross-holes and establishes the setting so the secondary contacts engage at approximately the same time as the moving contacts.

A portion of the moving contact rod extends through the cap that captures the compression springs to which a flexible lead or other current exchange method, such as garter springs or multi-lam current transfer devices may be attached. As the primary contact rod moves to the closed position, it can be seen that the secondary contacts will engage just before the primary moving contact engages the stationary contact. No current exchange is needed for the main contact rod as the electric current flows from the stationary contact of the primary contact set to the moving contact, up the contact drive rod and through the secondary contacts and out the top terminal of the interrupter. A system of capacitors and resistors connected to ground is provided in the insulated portion of the external contact drive rod to balance the voltage between the two contact systems to provide more efficient interruption of the electric current. The contacts may be of the butt style, transverse magnetic field or axial magnetic field designs as used in prior art. The invention described above is suitable for use in oil or SF6 switchgear.

A ramification of the invention provides for the coaxial alignment of the primary and secondary contact systems. In this case the primary moving contact is cup shaped and the moving contact rod extends through the primary moving contact just far enough so the face of the primary and secondary moving contacts lie in the same plane. The moving contact rod for the floating contact is extended far enough so it passes through the primary stationary contact to the point that the floating contact and primary stationary contact lie in approximately the same plane. The adjustment mechanism described above would be utilized so that the floating and secondary moving contacts engage approximately 1/32 of an inch before the primary contacts. As stated above, this allows for any wear of the primary contacts due to interruption duty or yielding of the contact rod due to repeated impact upon closing. The contacts may be of the butt style, transverse magnetic field or axial magnetic field designs as used in prior art. Axial magnetic field contacts employed in this invention will actually produce a coaxial magnetic field and yield a more effective interruption due to the cancellation of magnetic fields outside the contact structure. The stationary contact may also be made cup shaped to stabilize the arc at the outside contact ring and eliminate the expulsion of plasma from the interruption into the contact shield.

A further ramification of the invention allows the double break vacuum interrupter to be encapsulated. This is facilitated by the addition of an added housing which prevents the encapsulation material from contacting the moving components of the adjuster mechanism. The housing includes a metallic cylinder with a top made from insulating material. The portions of the housing are preferably retained in place by screws, which engage insulators, which are secured to studs that are brazed to the end-cup of the interrupter. A flexible lead transfers current from the floating contact rod to a terminal, which extends out of the top of the housing. A terminal rod is extended out from the stationary contact. This configuration may be encapsulated using the various techniques known in the art.

DESCRIPTION OF THE PREFERRED EMBODIMENTS

Figure 1:
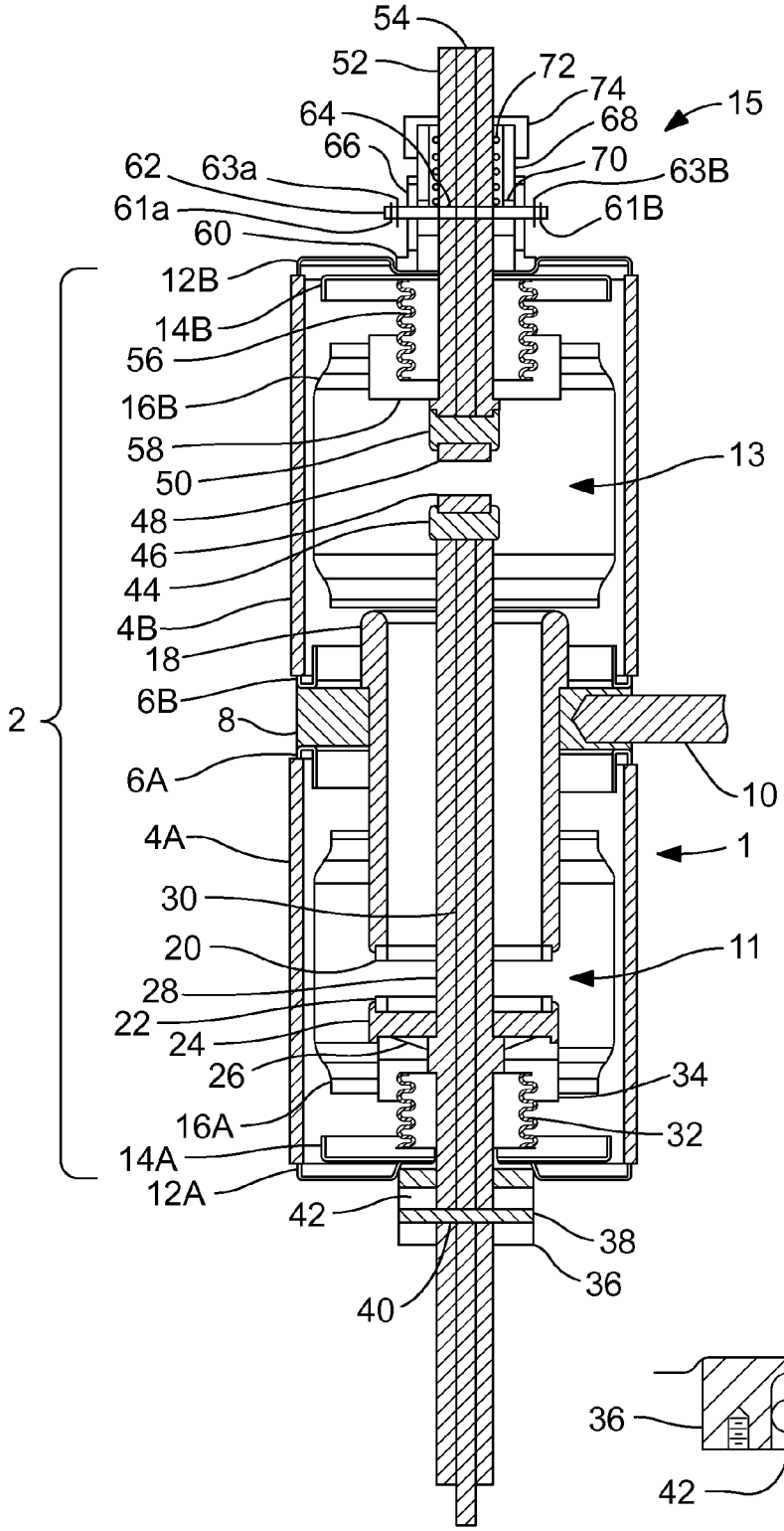
FIG. 1 is a cross-sectional view of a double break vacuum switch including a vacuum envelope in accordance with the present invention.

FIG. 1 discloses a double break vacuum switch (vacuum switch) 1. The vacuum switch 1 includes a vacuum envelope 2. The major part of the vacuum envelope 2 includes a pair of insulating cylinders 4A and 4B preferably fabricated from alumina ceramic joined end-to-end by way of two stainless steel or monel triple point shields 6A and 6B and a stationary contact support ring 8, preferably fabricated from copper. A threaded hole in the stationary contact support ring 8 allows the attachment of a terminal rod 10 to facilitate electrical connection to a source line. Opposite ends of the ceramic cylinders are enclosed by two end cups 12A and 12B, preferably fabricated from stainless steel or monel. A second set of triple point shields 14A and 14B preferably fabricated from stainless steel or monel are attached to the end cups. A generally tubular internal shield 16A and 16B is provided within each insulating cylinder 4A and 4B spaced from the interior wall and overlapping the triple point shields to prevent any vaporized material from contacting the interior wall.

Figure 1A:
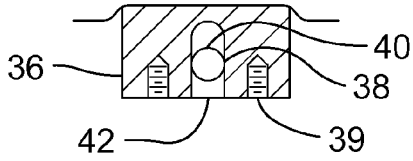
FIG. 1*a* is an enlarged cross-sectional side view of a bellows anti-twist housing of a double break vacuum switch in accordance with the present invention.

The primary contact system 11 includes an annular stationary contact support 18 preferably fabricated from copper and is attached to the aforementioned stationary contact support ring 8. An annular stationary contact 20 preferably made of copper tungsten is attached to a lower end of the stationary contact support 18. The stationary contact 20 is engaged by an annular moving contact 22 also preferably fabricated from copper tungsten. The annular moving contact 22 is attached to a disc shaped moving contact support 24 preferably fabricated from copper. The moving contact support 24 is reinforced by a moving contact reinforcement cone 26 preferably fabricated from stainless steel. Both the moving contact support 24 and moving contact reinforcement cone 26 are retained on a moving contact rod 28, preferably fabricated from copper. The moving contact rod 28 is reinforced by a reinforcing rod 30, preferably fabricated from stainless steel and is sealingly passed through the end cup 12A and the triple point shield 12B by a bellows 32. The bellows 32 is preferably fabricated from stainless steel. The end of the reinforcing rod 30 is preferably threaded and extends beyond the lower end of the moving contact rod 28 to facilitate the attachment of a drive rod from an external drive mechanism. The bellows 32 is preferably protected from damage by vaporized material by a bellows shield 34. The bellows shield is preferably fabricated from stainless steel. A bellows anti-twist housing 36 is attached to the opposite side of end cup 12A and is centered by the circular depression formed in the end cup. The bellows anti-twist housing 36 is preferably fabricated from stainless steel. With reference to FIG. 1*a*, the bellows anti-twist housing 36 is indexed to the moving contact rod 28 by a hardened pin 38, preferably fabricated from steel and nickel plated. The hardened pin 38 passes through a cross-hole 40 in the moving contact rod 28 and slides in a slot 42 in the bellows anti-twist housing 36. Two threaded holes 39 are formed in the bellows anti-twist housing 36 to facilitate attachment of a current exchange housing 126.

A second contact system 13 includes the extension of the moving contact rod 28, which passes through the moving contact support 18. A moving contact support 44 preferably fabricated from copper is attached to an end of the moving contact rod. A moving contact disc 46 preferably fabricated from copper tungsten is attached to the moving contact support 44. The second contact system 13 further includes a floating contact 48 preferably fabricated from copper tungsten, which is attached to an end of a disc-shaped floating contact support 50, preferably fabricated from copper. The floating contact support 50 is attached to a floating contact rod 52 preferably fabricated from copper, which is reinforced by a reinforcing rod 54 preferably fabricated from stainless steel and sealingly passed through end cup 12B and triple point shield 14B by a bellows 56. The bellows 56 is protected from damage by vaporized material by a bellows shield 58. The bellows 56 and the bellows shield 58 are preferably fabricated from stainless steel. A mechanism housing 60 preferably fabricated from stainless steel is attached to the opposite side of end cup 12B and is centered by the circular depression formed in the end cup. The mechanism housing 60 is indexed to the floating contact rod 52 by a hardened pin 62 preferably fabricated from a nickel plated steel, which passes through a cross-hole 64 in the floating contact rod 52 and slides in a slot 66 in the mechanism housing 60. During the brazing cycle for the vacuum switch 1, a pin 62 is replaced by a fixture pin to assure the alignment of these parts.

An operating mechanism for a floating contact 15 includes an adjuster 68 preferably fabricated from brass, which is threaded into the mechanism housing 60. The mechanism housing 60 includes two slots 66 located at opposite sides around its circumference. The adjuster 68 has six holes 70 equally spaced around its perimeter, so that the pin 62 can be inserted into any opposite facing pair of holes 70 during the adjustment process. When threading the adjuster 68 into the mechanism housing 60, the pin 62 is withdrawn from the mechanism housing 60. The adjuster 68 is positioned so that the center of one pair of holes 70 line up with the center of the cross hole 64 in the floating contact rod 52 and the top of hole 70 is preferably 0.031 inch above cross-hole 64, but other dimensions may also be used. During this adjustment, both the first and second set of contacts must be closed. The pin 62 is then inserted back through the mechanism housing 60, adjuster 68 and the floating contact rod 52. Pin 62 is held in place by a pair of retaining rings 61A and 61B and a pair of washers 63A and 63B. The pair of retaining rings 61A and 61B and the pair of washers 63A and 63B are both preferably fabricated from steel. A compression spring 72 preferably made of music wire is inserted into the counter-bore in the adjuster 68 and a threaded spring retainer 74 is tightened. The threaded spring retainer 74 is preferably fabricated from a nickel plated steel. The compression spring 72 forces the pin 62 to the bottom of the hole 70. The diameter of the holes 70 in the adjuster 68 are preferably 0.062 larger than the diameter of the cross hole in the floating contact rod 52 to provide for an allowance for contact wear. The slots 66 in the mechanism housing 60 have a minimum length equal to the tolerance build-up between the location of the cross hole 64 in the floating contact rod 52 and the end of the second moving contact 46 plus the diameter of the holes 70 in the adjuster 68. This allows the adjuster 68 to be able to be adjusted through the full range of possible locations of the cross hole 64.

Figure 2:
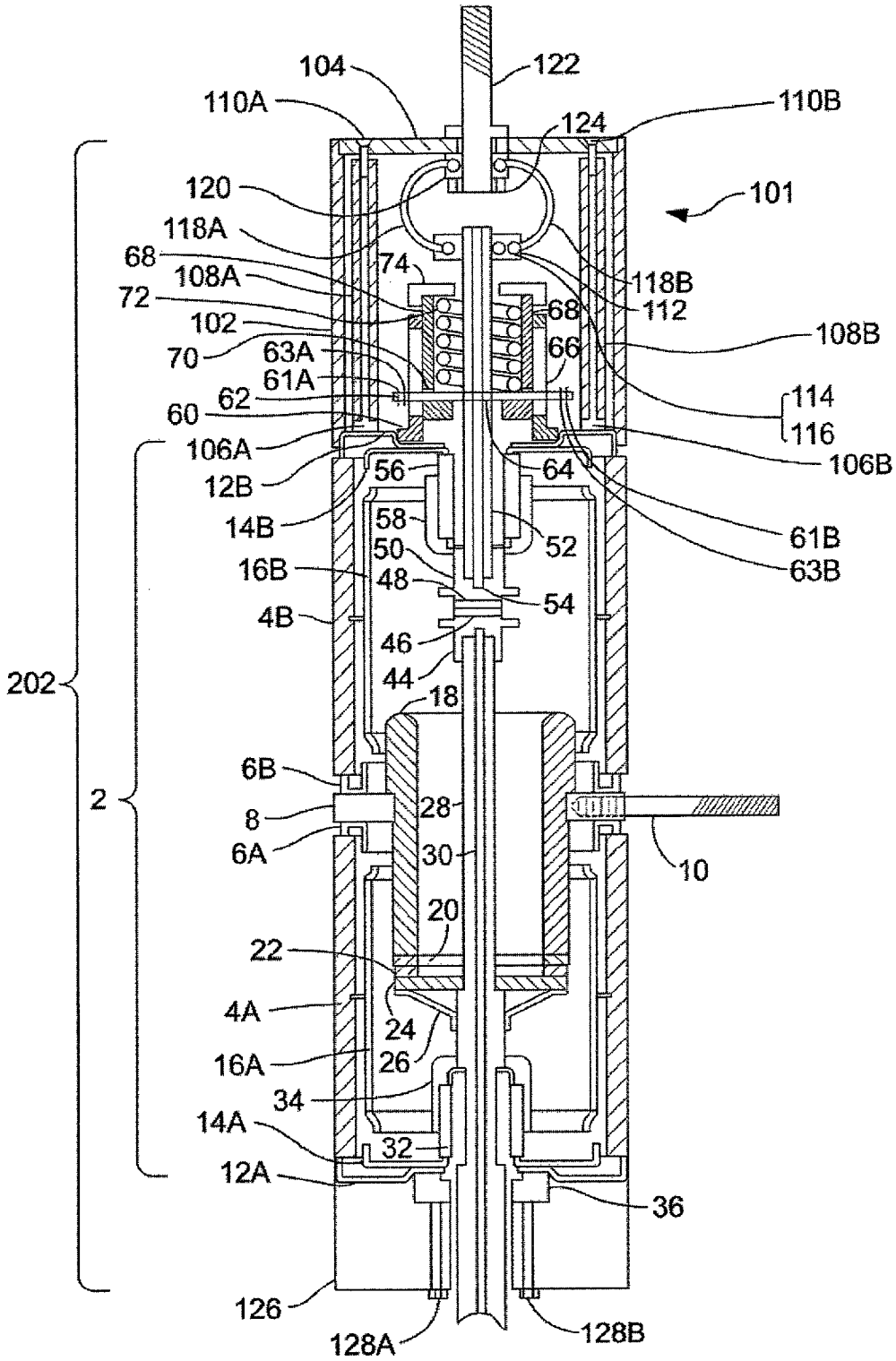
FIG. 2 is a cross-sectional view of a double break vacuum switch prepared for encapsulation in accordance with the present invention.

In order to facilitate encapsulation of the double break vacuum switch 1; a housing 101 is placed over the mechanism as shown in FIG. 2. The housing includes a cover housing 102 preferably fabricated from aluminum and a cover plate 104 preferably fabricated from an insulating material such as GP01 or GP03 fiberglass or G10 epoxy glass. A pair of studs 106A and 106B preferably fabricated from stainless steel are attached to an outside surface of the end cup 12B. An insulating stringer 108A and 108B preferably fabricated from filament wound epoxy glass is threaded onto each stud 106A and 106B. A screw 110A and 110B preferably fabricated from stainless steel is threaded into the opposite end of each stringer 108A and 108B to retain the cover plate 104 and the cover housing 102. A split-clamp connector 112 preferably fabricated from copper and is tightened onto an end of floating contact rod 52 using a bolt 114 and nut 116. A pair of highly flexible multi-stranded conductors 118A and 118B preferably fabricated from copper are conductively secured to the split clamp connector 112 on one end and to a terminal connector 120 preferably fabricated from copper on the other end thereof. The terminal connector is preferably threaded onto a lower portion of a source terminal 122 and secured with a jam nut 124; creating a current exchange between the floating contact rod 52 and the source terminal 122. The opposite end of the vacuum switch 1 is prepared for encapsulation by installation of the current exchange housing 126 over the bellows anti-twist housing 36 and securing it with a pair of bolts 128A and 128B preferably fabricated from stainless steel. The current exchange housing 126 is preferably fabricated from a thermoset plastic.

Figure 3:
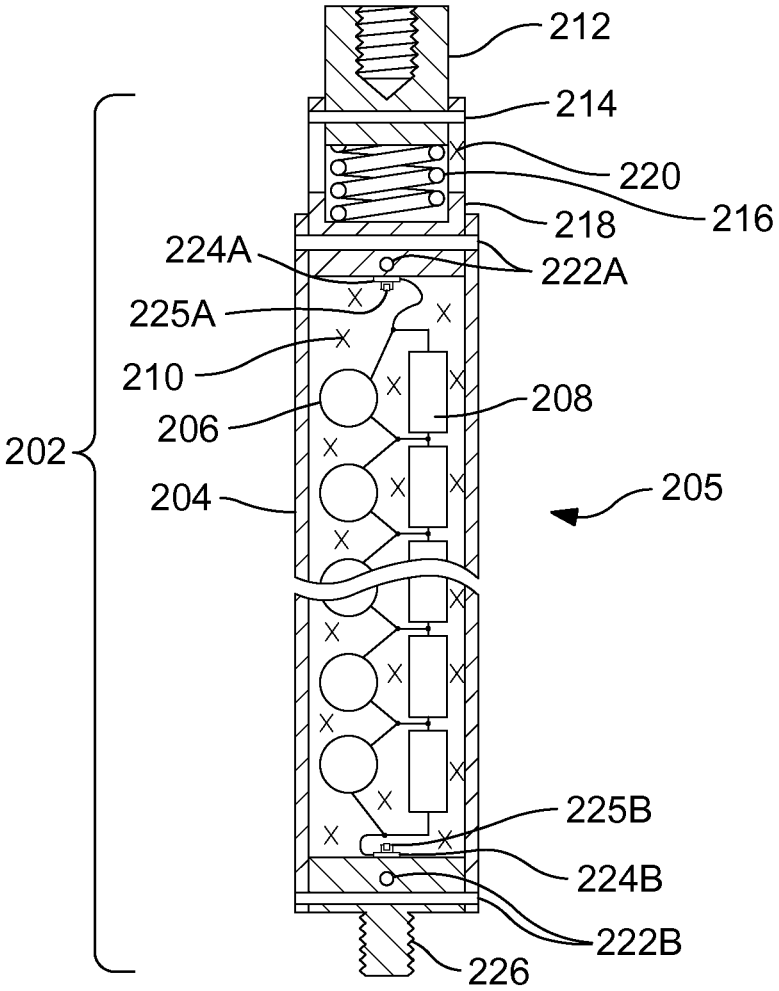
FIG. 3 is a cross-sectional view of an operating rod of a double break vacuum switch in accordance with the present invention.

The double break vacuum switch 1 requires a capacitor-resistor voltage divider to distribute the voltage equally between the two contact gaps during interruption. As shown in FIG. 3, this is provided by an operating rod 202. The operating rod 202 includes an insulating tube 204 preferably made from a filament wound epoxy glass and of a sufficient diameter to allow the insertion of a capacitor-resistor network 205, which includes a plurality of capacitors 206 and a plurality of resistors 208. The capacitors 206 are preferably 500 pf 30 kV disc capacitors and the resistors are preferably 20 Meg-ohm 2 watt resistors. Each capacitor 206 is connected in parallel with a single resistor 208. Fifteen of these capacitor-resistor units are connected in series on the inside of the insulating tube 204 and the insulating tube 204 is filled with an epoxy 210 or the like to improve dielectric characteristics. The operating rod 202 also requires a minimum length of 29 inches between live parts to allow operation at line voltages up to 72 kV. The end of the contact rod 28 connected to the double break vacuum switch 1 includes a contact pressure device. The contact pressure device includes an adapter 212 preferably fabricated from steel, a pin 214 preferably fabricated from steel, a spring 216 preferably fabricated from music wire and an outer shell 218 preferably fabricated from brass. The pin 214 allows the adapter 212 to ride up and down the slot 220 in outer shell 218 with the force of the spring 216 biasing the adapter 212 toward the upper end of the slot. The outer shell 218 is pinned to the insulating tube 204 with roll pins or groove pins 222 both preferably fabricated from steel and having a terminal 224A preferably fabricated from a tin plated brass and attached with a screw 225A preferably fabricated from a tin plated steel to allow connection of one end of the capacitor-resistor network. The other end of the insulating tube 204 includes an adapter 226 preferably fabricated from steel to allow the operating rod 202 to be connected to an operating mechanism. The adapter 226 is pinned to the insulating tube 204 with roll pins or groove pins 222B both preferably fabricated from steel and a terminal 224B preferably fabricated from a tin plated brass and attached with a screw 225B preferably fabricated from a tin plated steel to allow connection of the other end of the capacitor-resistor network 205.

Figure 4:
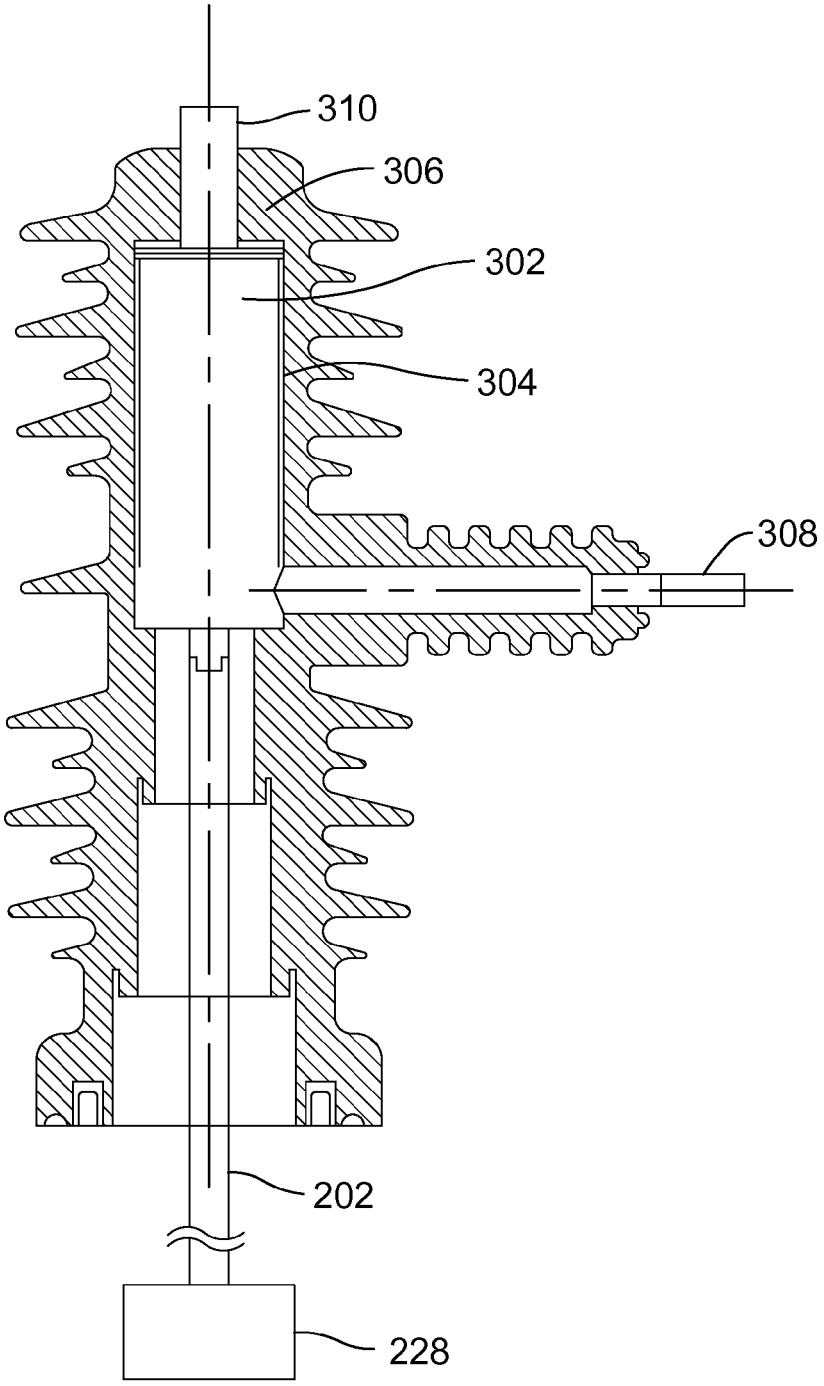
FIG. 4 is a cross-sectional view of a method of encapsulating a double break vacuum switch in accordance with the present invention.

There are several examples of prior art, which show the encapsulation of vacuum modules. FIG. 4 indicates one possible way of encapsulating the aforementioned vacuum switch as demonstrated by U.S. Pat. No. 5,917,167. A module 302 includes the vacuum envelope 2 and the vacuum housing 101. The module 302 is encased in a silicone rubber tube 304 and cast in an encapsulation 306 preferably of epoxy. The result is a two terminal encapsulation with a source terminal 308 and a load terminal 310. Within the vacuum interrupter module 302 both the primary and second sets of contacts are electrically connected in series via the extended portion of contact rod 28 and no current is conducted through the lower portion of the moving contact rod 28, which eliminates the need for a current exchange system at that point.

In operation, the aforementioned encapsulated double break vacuum switch 1 would be coupled by the operating rod 202 to an operating mechanism 228. A closing stroke of the operating mechanism 228 and the operating rod 202 would drive the moving contact rod 28 upward. Because of the aforementioned adjustment of the mechanism adjuster 68, when the spring 72 is installed, the pin 62 is forced to the bottom of the hole 70, which causes the floating contact rod 52 to be pushed downward 0.031 inch. This causes the second set of contacts 46 and 48 to engage slightly in advance of the first set of contacts 20, 22. As the moving contact rod 28 continues its closing stroke, the floating contact rod 52 is driven upward resulting in the pin 62 moving upward in the hole 70 and compressing spring 72. The closing stroke is completed when moving contact rod 28 is driven to a point that the first set of contacts 20, 22 make contact, which results in the pin 62 being centered in the hole 70. At this point, electric current flows from the source terminal 308 through the first set and second of contacts and directly out the load terminal 310.

Upon initiation of the opening stroke, the moving contact rod 28 moves downward causing the first set of contacts 20, 22 to immediately part and initiate an arc. The energy stored in the spring 72 forces the floating contact rod 52 downward maintaining contact through the second set of contacts 46, 48 for the first 0.031 inch of contact travel until the pin 62 is driven to the bottom of hole 70. At this point, floating contact rod 52 is no longer able to follow moving contact rod 28 downward and the second set of contacts 46, 48 begin to part initiating a second arc. The capacitor-resistor network 205 contained in the operating rod 202 acts to distribute the voltage evenly across the two contact gaps resulting in an efficient interruption of the arc as the moving contact rod 28 completes its opening stroke and provides the full open gap for both set of contacts. Because both sets of contacts are electrically connected in series, this results in a double break of the arc when the contacts open allowing the vacuum interrupter to be utilized at elevated voltages. The fact that the hole 70 is preferably 0.062 larger than the pin 62, allows +/−0.031 for wear of the contacts, which may be unequally distributed between either set of contacts.

Figure 5:
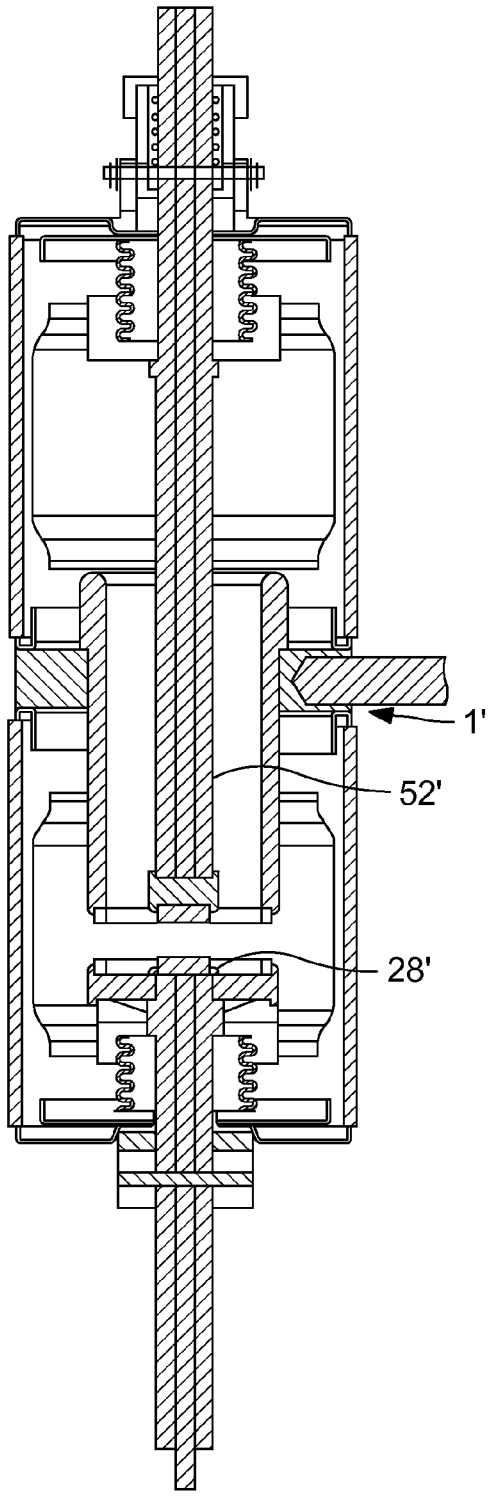
FIG. 5 is a cross-sectional view of a first alternative embodiment of a double break vacuum switch in accordance with the present invention.

A first alternative embodiment of the double break vacuum switch 1' is shown in FIG. 5. In this case, the length of the moving contact rod 28' is reduced and the length of floating contact rod 52' is increased so both the first set and second set of contacts part in the same plane. This embodiment eliminates the passage of the moving contact rod 28' through the arc zone of the first set of contacts.

Figure 6:
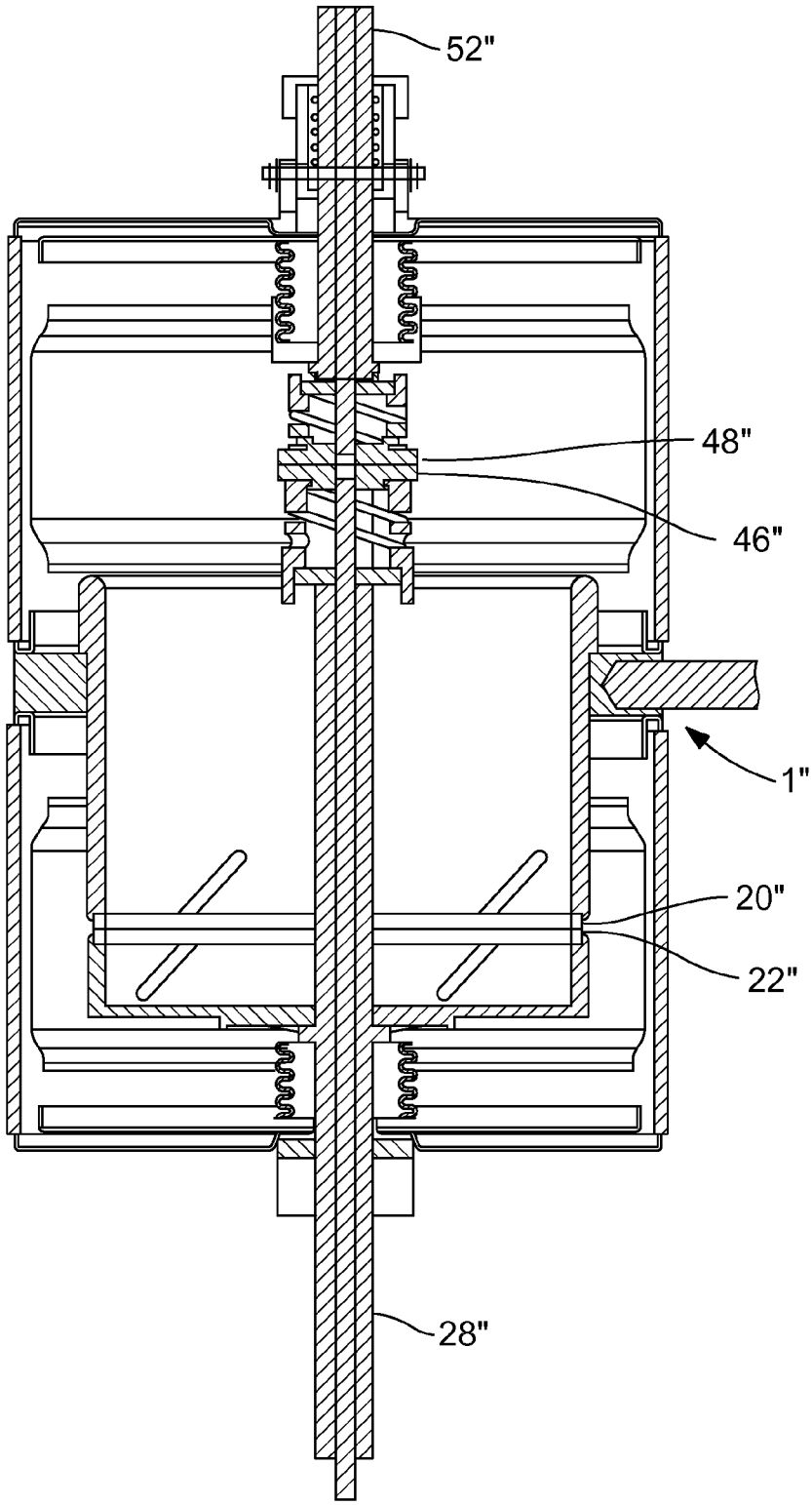
FIG. 6 is a cross-sectional view of a second alternative embodiment of a double break vacuum switch in accordance with the present invention.

FIG. 6 shows a second alternative embodiment of the double break vacuum switch 1". The annular stationary contact 20", the annular moving contact 22", the moving contact disc 46" and the floating contact 48" are preferably fabricated from copper chromium instead of copper tungsten utilizing any of the transverse or axial magnetic field contact structures shown in prior art. FIG. 6 shows one possible axial magnetic field contact structure as demonstrated by U.S. Pat. Nos. 4,871,888 and 6,867,385, and US Pat App No. 2006/0016787, which are hereby incorporated into this application by reference in their entirety. The double break vacuum switch 1" includes contact rods 28", 52". The revised contact structures convert the contacts 20", 22", 46" and 48" from switching duty to fault interrupting duty and results in a double break vacuum interrupter.

Figure 7:
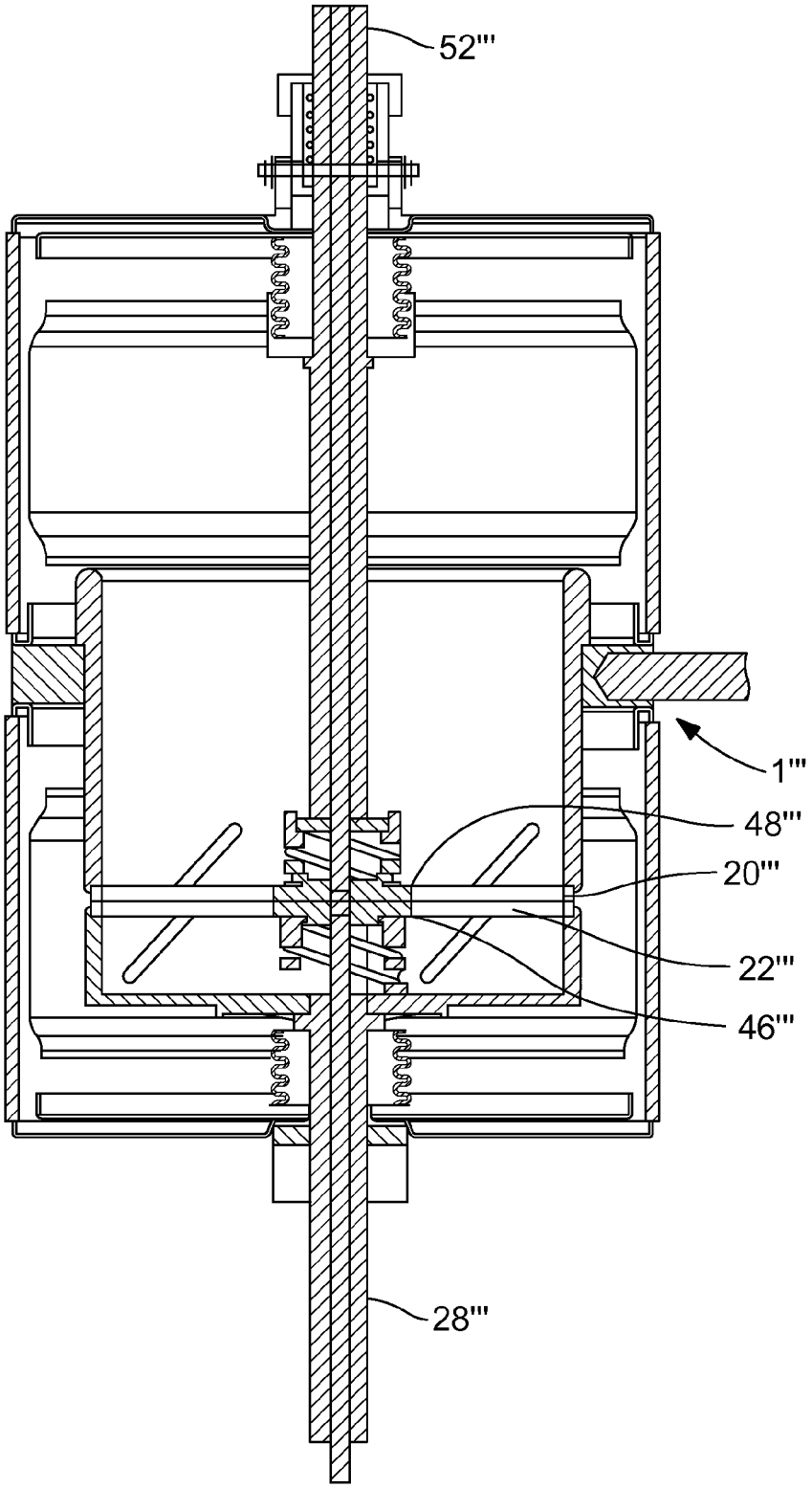
FIG. 7 is a cross-sectional view of a third alternative embodiment of a double break vacuum switch in accordance with the present invention.

FIG. 7 illustrates a third alternative embodiment of the double break vacuum switch 1' with coplanar axial magnetic field contacts. In this case, the length of the moving contact rod 28''' is reduced and the length of the floating contact rod 52''' is increased, so both sets of axial magnetic field contacts 20''', 22''', 46''' and 48''' are in the same plane. In this embodiment the fields are coaxial and the interruption would benefit from the fact that in a coaxial electrical system, the fields of the two conductors cancel outside the enclosing conductor so that the effect outside magnetic fields is shielded from the central conductor.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A double break vacuum interrupter comprising:

a vacuum enclosure having a first end and a second end, said second end is opposite to said first end;

a first contact system includes a moving contact and a stationary contact, said stationary contact is retained inside said vacuum enclosure at substantially said first end thereof; and a second contact system includes a moving contact rod, a floating contact rod and a biasing means, said floating contact rod having a first rod end and a second rod end, said second rod end is opposite to said first rod end, said floating contact rod is slidably retained at said second end of said vacuum enclosure, said biasing means is retained on said second end of said vacuum enclosure, substantially said first rod end of said floating contact rod is retained by said biasing means, said second rod end of said floating contact rod is biased toward said first end of said vacuum enclosure, said moving contact is retained on said moving contact rod, wherein said first and second contact systems close at substantially the same time.

2. The double break vacuum interrupter of claim 1, wherein:

a capacitor-resistor voltage divider is connected in series with said moving contact rod to distribute voltage equally between said first and second contact systems during interruption of electrical current flow.

3. The double break vacuum interrupter of claim 1, further comprising:

said double break vacuum interrupter is encapsulated in a solid dielectric insulation.

4. The double break vacuum interrupter of claim 1, further comprising:

said moving contact having an annular moving contact pad, said stationary contact having an annular shape, said stationary contact having an annular stationary contact pad.

5. The double break vacuum interrupter of claim 1, further comprising:

said biasing means includes a mechanism housing, a threaded adjuster, a compression spring and an end cap, said mechanism housing is secured to said second end of said vacuum enclosure, said threaded adjuster is threadably engaged with said mechanism housing, said threaded adjuster including a spring bore for receiving said compression spring, said end cap retaining said compression spring in said spring bore.

6. The double break vacuum interrupter of claim 5, further comprising:

at least two adjuster openings are formed through said threaded adjuster to receive an anti-rotation pin, at least two housing openings are formed through said mechanism housing to receive said anti-rotation pin and a hole is formed through said floating contact rod to receive said anti-rotation pin.

7. The double break vacuum interrupter of claim 1 wherein:

said contacts being at least one of butt type, transverse magnetic field and axial magnetic field.

8. A double break vacuum interrupter comprising:

a vacuum enclosure having a first end and a second end, said second end is opposite to said first end;

a first contact system includes a moving contact and a stationary contact, said stationary contact is retained inside said vacuum enclosure at substantially said first end thereof; and a second contact system includes a moving contact rod, a floating contact rod and a biasing means, said floating contact rod having a first rod end and a second rod end, said second rod end is opposite to said first rod end, said floating contact rod is slidably retained at said second end of said vacuum enclosure, said biasing means is retained on said second end of said vacuum enclosure, substantially said first rod end of said floating contact rod is retained by said biasing means, said second rod end of said floating contact rod is biased toward said first end of said vacuum enclosure, said moving contact is retained on said moving contact rod, a distance that said floating contact rod extends from said biasing means is adjustable, wherein said first and second contact systems close at substantially the same time.

9. The double break vacuum interrupter of claim 8, wherein:

a capacitor-resistor voltage divider is connected in series with said moving contact rod to distribute voltage equally between said first and second contact systems during interruption of electrical current flow.

10. The double break vacuum interrupter of claim 8, further comprising:

said double break vacuum interrupter is encapsulated in a solid dielectric insulation.

11. The double break vacuum interrupter of claim 8, further comprising:

said moving contact having an annular moving contact pad, said stationary contact having an annular shape, said stationary contact having an annular stationary contact pad.

12. The double break vacuum interrupter of claim 8, further comprising:

said biasing means includes a mechanism housing, a threaded adjuster, a compression spring and an end cap, said mechanism housing is secured to said second end of said vacuum enclosure, said threaded adjuster is threadably engaged with said mechanism housing, said threaded adjuster including a spring bore for receiving said compression spring, said end cap retaining said compression spring in said spring bore.

13. The double break vacuum interrupter of claim 12, further comprising:

at least two adjuster openings are formed through said threaded adjuster to receive an anti-rotation pin, at least two housing openings are formed through said mechanism housing to receive said anti-rotation pin and a hole is formed through said floating contact rod to receive said anti-rotation pin.

14. The double break vacuum interrupter of claim 8 wherein:

said contacts being at least one of butt type, transverse magnetic field and axial magnetic field.

15. A double break vacuum interrupter comprising:

a vacuum enclosure having a first end and a second end, said second end is opposite to said first end;

a first contact system includes a moving contact and a stationary contact, said stationary contact is retained inside said vacuum enclosure at substantially said first end thereof; and a second contact system includes a moving contact rod, a floating contact rod and a biasing means, said floating contact rod having a first rod end and a second rod end, said second rod end is opposite to said first rod end, said floating contact rod is slidably retained at said second end of said vacuum enclosure, said biasing means is retained on said second end of said vacuum enclosure, substantially said first rod end of said floating contact rod is retained by said biasing means, said second rod end of said floating contact rod is biased toward said first end of said vacuum enclosure, said moving contact is retained on said moving contact rod, wherein said first and second contact systems close at substantially the same time; and a capacitor-resistor voltage divider is connected in series with said moving contact rod to distribute voltage equally between said first and second contact systems during interruption of electrical current flow, wherein said first and second contact systems close at substantially the same time.

16. The double break vacuum interrupter of claim 15, further comprising:

said vacuum switch is encapsulated in a solid dielectric insulation.

17. The double break vacuum interrupter of claim 15, further comprising:

said moving contact having an annular moving contact pad, said stationary contact having an annular shape, said stationary contact having an annular stationary contact pad.

18. The double break vacuum interrupter of claim 15, further comprising:

said biasing means includes a mechanism housing, a threaded adjuster, a compression spring and an end cap, said mechanism housing is secured to said second end of said vacuum enclosure, said threaded adjuster is threadably engaged with said mechanism housing, said threaded adjuster including a spring bore for receiving said compression spring, said end cap retaining said compression spring in said spring bore.

19. The double break vacuum interrupter of claim 18, further comprising:

at least two adjuster openings are formed through said threaded adjuster to receive an anti-rotation pin, at least two housing openings are formed through said mechanism housing to receive said anti-rotation pin and a hole is formed through said floating contact rod to receive said anti-rotation pin.

20. The double break vacuum interrupter of claim 15 wherein:

said contacts being at least one of butt type, transverse magnetic field and axial magnetic field.

* * * * *